US009881575B2

(12) United States Patent
Choi et al.

(10) Patent No.: US 9,881,575 B2
(45) Date of Patent: Jan. 30, 2018

(54) METHOD OF DRIVING DISPLAY PANEL AND DISPLAY APPARATUS FOR PERFORMING THE SAME

(71) Applicant: Samsung Display Co., Ltd., Yongin-si, Gyeonggi-Do (KR)

(72) Inventors: Hak-Mo Choi, Seoul (KR); Hoi-Sik Moon, Asan-si (KR); Min-Yup Chae, Cheonan-si (KR)

(73) Assignee: Samsung Display Co., Ltd, Yongin-si (KR)

( * ) Notice: Subject to any disclaimer, the term of this patent is extended or adjusted under 35 U.S.C. 154(b) by 16 days.

(21) Appl. No.: 14/717,434

(22) Filed: May 20, 2015

(65) Prior Publication Data

US 2016/0019824 A1 Jan. 21, 2016

(30) Foreign Application Priority Data

Jul. 15, 2014 (KR) ..... 10-2014-0089182

(51) Int. Cl.

| | |
|---|---|
| ***G09G 3/20*** | (2006.01) |
| ***G09G 5/06*** | (2006.01) |
| ***G09G 3/36*** | (2006.01) |

(52) U.S. Cl.

CPC ... *G09G 3/3666* (2013.01); *G09G 2300/0413* (2013.01); *G09G 2320/029* (2013.01); *G09G 2320/0223* (2013.01); *G09G 2320/0233* (2013.01); *G09G 2320/0271* (2013.01); *G09G 2320/0285* (2013.01); *G09G 2330/08* (2013.01); *G09G 2330/12* (2013.01)

(58) Field of Classification Search

CPC ... G09G 2320/0233; G09G 2320/0285; G09G 2320/0271; G09G 2330/08; G09G 2330/12; G09G 2300/0413; G09G 2320/029; G09G 3/20; G09G 3/2007; G09G 3/027; G09G 5/06; G09G 2310/0251; G09G 2330/028; G09G 2320/0626; G09G 3/3666; G09G 2320/0223

See application file for complete search history.

(56) References Cited

U.S. PATENT DOCUMENTS

| | | | | |
|---|---|---|---|---|
| 6,252,572 | B1 * | 6/2001 | Kurumisawa | G09G 3/3625 345/100 |
| 2008/0252668 | A1 * | 10/2008 | Chen | G09G 3/3648 345/690 |
| 2011/0148852 | A1 * | 6/2011 | Kim | G09G 3/20 345/213 |
| 2011/0170014 | A1 * | 7/2011 | Irie | G09G 3/3614 348/731 |

(Continued)

FOREIGN PATENT DOCUMENTS

| | | | |
|---|---|---|---|
| KR | 10-2004-0065966 | A | 7/2004 |
| KR | 10-2006-0119269 | * | 11/2006 |

(Continued)

*Primary Examiner* — Md Saiful A Siddiqui
(74) *Attorney, Agent, or Firm* — H.C. Park & Associates, PLC

(57) ABSTRACT

A method of driving a display panel includes outputting a dummy gate voltage to a gate line disposed on a boundary of a first area of the display panel and a second area of the display panel adjacent to the first area during a blank period between a plurality of scanning periods and outputting a dummy data voltage to a data line during the blank period.

15 Claims, 6 Drawing Sheets

(56) References Cited

U.S. PATENT DOCUMENTS

| | | | | |
|---|---|---|---|---|
| 2012/0162165 | A1* | 6/2012 | Lee | G09G 3/006<br>345/206 |
| 2012/0212474 | A1* | 8/2012 | Hwang | G09G 3/3648<br>345/212 |
| 2015/0109357 | A1* | 4/2015 | Nakai | G09G 3/36<br>345/691 |

FOREIGN PATENT DOCUMENTS

| | | | |
|---|---|---|---|
| KR | 10-2007-0045045 | A | 5/2007 |
| KR | 10-2008-0010946 | A | 1/2008 |
| KR | 10-2008-0075687 | A | 8/2008 |

* cited by examiner

METHOD OF DRIVING DISPLAY PANEL AND DISPLAY APPARATUS FOR PERFORMING THE SAME

CLAIM PRIORITY

This application makes reference to, incorporates the same herein, and claims all benefits accruing under 35 U.S.C. § 119 from an application earlier filed in the Korean Intellectual Property Office on 15 Jul. 2014 and there duly assigned Serial No. 10-2014-0089182.

BACKGROUND OF THE INVENTION

1. Field of Invention

Exemplary embodiments of the present inventive concept relate to a method of driving display panel and a display apparatus for performing the method of driving display panel. More particularly, the present inventive concept relates generally to a method of driving display panel capable of decreasing a defect of a display panel and a display apparatus for performing the method of driving display panel.

2. Description of the Related Art

A display apparatus such as a liquid crystal display apparatus includes a display panel and a driving apparatus configured to drive the display panel. The driving apparatus includes a gate driving part, a data driving part and a timing controlling.

Generally, the display apparatus includes one driving apparatus. However, when the display apparatus has one driving apparatus, a charging rate may be decreased.

To improve the problem, a display apparatus of a panel dividing type has been developed. The display apparatus of the panel dividing type divides a panel to drive a divided panel portion by respective driving apparatus. The display apparatus of the panel dividing type includes a plurality of driving apparatus. The display apparatus of the panel dividing type may improve a charging rate.

However, the display apparatus of the panel dividing type drives divided panel portions separately. Therefore, a difference of charging rate between the divided panel portions is occurred, so that a boundary of divided panel portions may be seen.

The above information disclosed in this Related Art section is only for enhancement of understanding of the background of the invention and therefore it may contain information that does not form the prior art that is already known to a person of ordinary skill in the art.

SUMMARY OF THE INVENTION

Exemplary embodiments of the present inventive concept provide a method of driving display panel capable of decreasing a defect of a display panel.

Exemplary embodiments of the present inventive concept provide a display apparatus for performing the method of driving display panel.

In an exemplary embodiment of a method of driving a display panel according to the present inventive concept, the method includes outputting a dummy gate voltage to a gate line disposed on a boundary of a first area of the display panel and a second area of the display panel adjacent to the first area during a blank period between a plurality of scanning periods and outputting a dummy data voltage to a data line during the blank period.

In an exemplary embodiment, the first area and the second area may be scanned in a direction away from the boundary.

In an exemplary embodiment, the method may further include outputting a normal gate voltage to the gate line during a scanning period and outputting a normal data voltage to the data line during a scanning period.

In an exemplary embodiment, the method may further include adjusting the normal data voltage applied to a pixel disposed on the boundary.

In an exemplary embodiment, a value and an applying time of the dummy gate voltage may be determined based on a grayscale value of the normal data voltage applied to a pixel disposed on the boundary.

In an exemplary embodiment, a value and an applying time of the dummy gate voltage may be determined based on a temperature of the boundary.

In an exemplary embodiment, the method may further include determining a value of the dummy data voltage based on a grayscale value of the normal data voltage applied to a pixel disposed on the boundary.

In an exemplary embodiment, a value of the dummy data voltage may be determined based on a temperature and a position of the boundary.

In an exemplary embodiment, the method may further include calculating a charging rate of a pixel disposed on the boundary. A value and an applying time of the dummy gate voltage and a value of the dummy data voltage may be determined based on the charging rate.

In an exemplary embodiment, calculating the charging rate of the pixel disposed on the boundary may include measuring a luminance of the display panel according to a position and calculating the charging rate based on the luminance.

In an exemplary embodiment of a display apparatus according to the present inventive concept, the display apparatus includes a display panel comprising a first area and a second area adjacent to the first area, and comprising a gate line and a data line disposed on the first and the second area, a timing controller configured to determine a value of a dummy data voltage and a value of a normal data voltage, a gate driving part configured to output a dummy gate voltage to a gate line disposed on a boundary of the first area and the second area during a blank period between a plurality of scanning periods and a data driving part configured to output a dummy data voltage to the data line during the blank period.

In an exemplary embodiment, the first area and the second area may be scanned in a direction away from the boundary.

In an exemplary embodiment, the gate driving part may output a normal gate voltage to the gate line during a scanning period. The data driving part may output a normal data voltage to the data line during a scanning period.

In an exemplary embodiment, the timing controller may include a look-up table in which a value and an applying time of the dummy gate voltage based on a grayscale value of the normal data voltage are stored.

In an exemplary embodiment, the timing controller may include a look-up table in which a value and an applying time of the dummy gate voltage based on a temperature of the boundary are stored.

In an exemplary embodiment, the timing controller may include a look-up table in which a value of the dummy data voltage based on a grayscale value of the normal data voltage is stored.

In an exemplary embodiment, the timing controller may include a look-up table in which a value of the dummy data voltage based on a temperature and a position of the boundary is stored.

In an exemplary embodiment, the timing controller may include a charging rate output part configured to calculate a charging rate of a pixel disposed on the boundary and a look-up table in which a value and an applying time of the dummy gate voltage based on the charging rate.

In an exemplary embodiment, the charging rate output part may include a luminance measurement part configured to measure a luminance of the display panel according to a position and a charging rate calculation part configured to calculate the charging rate based on the luminance.

According to the present exemplary embodiment, when a charging rate of a boundary of the first area and second area is deficient, the charging rate output part perceives the deficiency of the charging rate of the boundary, the correction part adjusts the dummy gate voltage, the dummy data voltage and the data voltage. In addition, since temperature, gray scale value and RC-delay of the display panel is considered, a compensation of charging rate may be more accurate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE EMBODIMENTS

Figure 1:
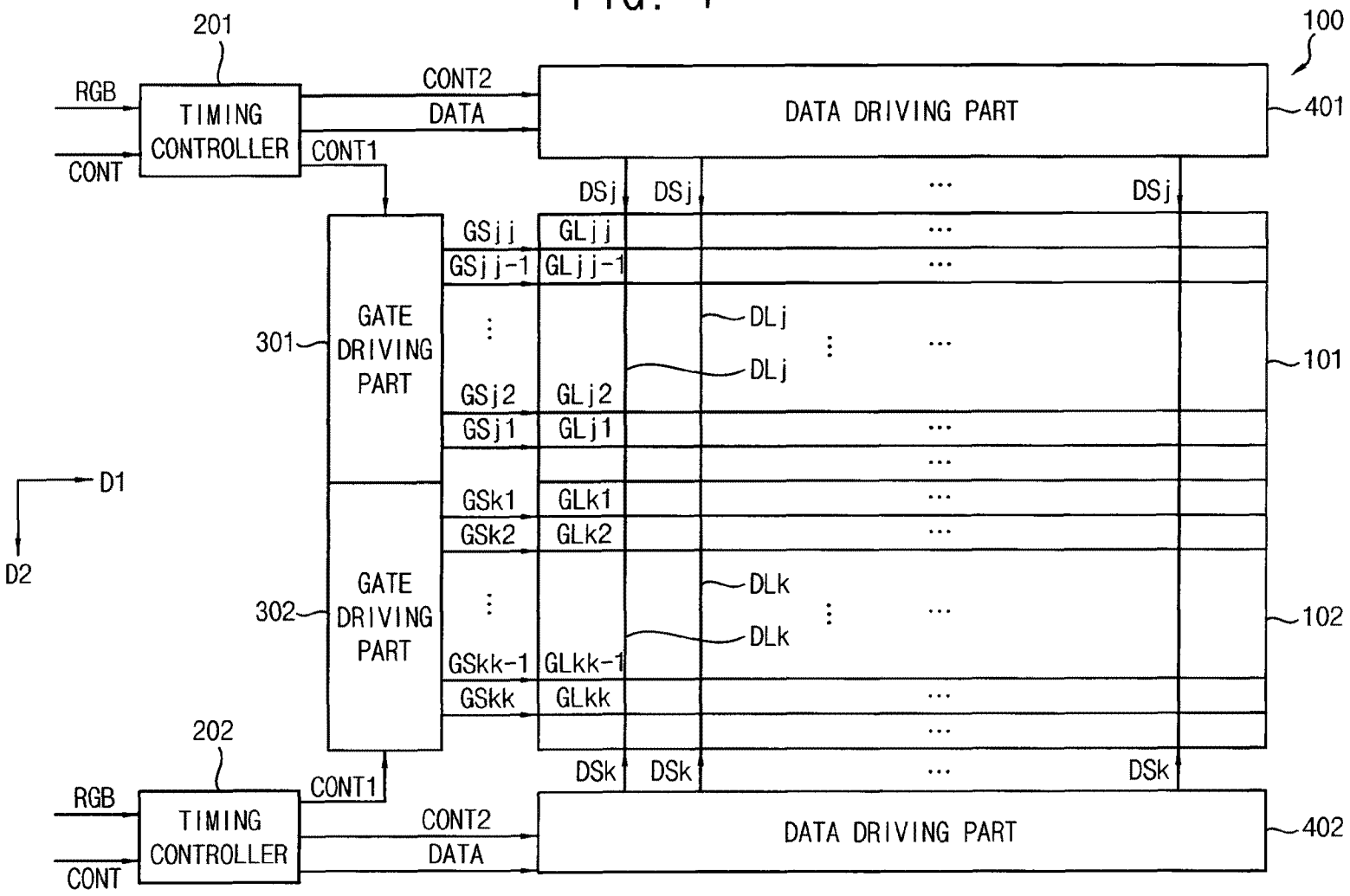
FIG. 1 is a block diagram illustrating a display apparatus according to an exemplary embodiment of the present inventive concept.

The example embodiments are described more fully hereinafter with reference to the accompanying drawings. The inventive concept may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display apparatus according to an exemplary embodiment of the present inventive concept.

Referring to FIG. 1, the display apparatus 100 according to an exemplary embodiment of the present inventive concept includes s first area 101, a second area 102, a first timing controller 201, a second timing controller 202, a first gate driving part 301, a second gate driving part 302, a first data driving part 401 and a second data driving part 402.

The first timing controller 201, the first gate driving part 301 and the first data driving part 401 may be a driving apparatus configured to drive the first area 101.

The second timing controller 202, the second gate driving part 302 and the second data driving part 402 may be a driving apparatus configured to drive the second area 102.

The first area 101 receives a data signal DSj based on an image data DATA provided from the first timing controller 201 to display an image. For example, the image data DATA may be two-dimensional plane image data. Alternatively, the image data DATA may include a left-eye image data and a right-eye image data for displaying a three-dimensional stereoscopic image.

The first area 101 includes first, second to (j−1)-th (j is a natural number) and j-th gate lines GLj1, GLj2, . . . , GLjj−1, GLjj, data lines DLj and a plurality of pixels. The first, second to (j−1)-th and j-th gate lines GLj1, GLj2, . . . , GLjj−1, GLjj extend in a first direction D1. The first, second to (j−1)-th and j-th gate lines GLj1, GLj2, . . . , GLjj−1, GLjj are sequentially disposed from a boundary between the first area 101 and the second area 102. The data lines DLj extend in a second direction D2 substantially perpendicular to the first direction D1. Each of the pixels includes a thin film transistor electrically connected to a gate line GL and a data line DL, a liquid crystal capacitor and a storage capacitor connected to the thin film transistor. The gate line GL may be one of the first, second to (j−1)-th and j-th gate lines GLj1, GLj2, . . . , GLjj−1, GLjj, and the data line DL may be one of the data lines DLj.

The second area 102 receives a data signal DSk based on the image data DATA provided from the second timing controller 202 to display the image. For example, the image data DATA may be two-dimensional plane image data. Alternatively, the image data DATA may include a left-eye image data and a right-eye image data for displaying a three-dimensional stereoscopic image.

The second area 102 includes first, second to (k−1)-th (k is a natural number) and k-th gate lines GLk1, GLk2, . . . , GLkk−1, GLkk, data lines DLk and the pixels P. The first, second to (k−1)-th and k-th gate lines GLk1, GLk2, . . . , GLkk−1, GLkk extend in the first direction D1. The first, second to (k−1)-th and k-th gate lines GLk1, GLk2, . . . , GLkk−1, GLkk are sequentially disposed from the boundary between the first area 101 and the second area 102. The data lines DLk extend in the second direction D2 substantially perpendicular to the first direction D1. Each of the pixels includes the thin film transistor electrically connected to the gate line GL and the data line DL, the liquid crystal capacitor and the storage capacitor connected to the thin film transistor. The gate line GL may be one of the first, second to (k−1)-th and k-th gate lines GLk1, GLk2, . . . , GLkk−1, GLkk, and the data line DL may be one of the data lines DLk.

The number of the first, second to (j−1)-th and j-th gate lines GLj1, GLj2, . . . , GLjj−1, GLjj disposed on the first area 101 and the number of the first, second to (k−1)-th and k-th gate lines GLk1, GLk2, . . . , GLkk−1, GLkk disposed on the second area 102 may be substantially the same.

The first timing controller 201 receives input image data RGB and an input control signal CONT from an external apparatus (not shown). The input image data may include red image data R, green image data G and blue image data B. The input control signal CONT may include a master clock signal and a data enable signal. The input control signal CONT may include a vertical synchronizing signal and a horizontal synchronizing signal.

The first timing controller 201 generates a first control signal CONT1, a second control signal CONT2 and a data signal DATA based on the input image data RGB and the input control signal CONT.

The first timing controller 201 generates the first control signal CONT1 for controlling an operation of the first gate driving part 301 based on the input control signal CONT, and outputs the first control signal CONT1 to the first gate driving part 301. The first control signal CONT1 may further include a vertical start signal and a gate clock signal.

The first timing controller 201 generates the second control signal CONT2 for controlling an operation of the first data driving part 401 based on the input control signal CONT, and outputs the second control signal CONT2 to the first data driving part 401. The second control signal CONT2 may include a horizontal start signal and a load signal. The second control signal CONT2 may further include an inversion control signal.

The first timing controller 201 generates the data signal DATA based on the input image data RGB. The first timing controller 201 outputs the data signal DATA to the first data driving part 401.

The second timing controller 202 receives input image data RGB and an input control signal CONT from an external apparatus (not shown). The input image data may include red image data R, green image data G and blue image data B. The input control signal CONT may include a master clock signal and a data enable signal. The input control signal CONT may include a vertical synchronizing signal and a horizontal synchronizing signal.

The second timing controller 202 generates a first control signal CONT1, a second control signal CONT2 and a data signal DATA based on the input image data RGB and the input control signal CONT.

The second timing controller 202 generates the first control signal CONT1 for controlling an operation of the second gate driving part 302 based on the input control signal CONT, and outputs the first control signal CONT1 to the second gate driving part 302. The first control signal CONT1 may further include a vertical start signal and a gate clock signal.

The second timing controller 202 generates the second control signal CONT2 for controlling an operation of the second data driving part 402 based on the input control signal CONT, and outputs the second control signal CONT2 to the second data driving part 402. The second control signal CONT2 may include a horizontal start signal and a load signal. The second control signal CONT2 may further include an inversion control signal.

The second timing controller 202 generates the data signal DATA based on the input image data RGB. The second timing controller 202 outputs the data signal DATA to the second data driving part 402.

Figure 3A:
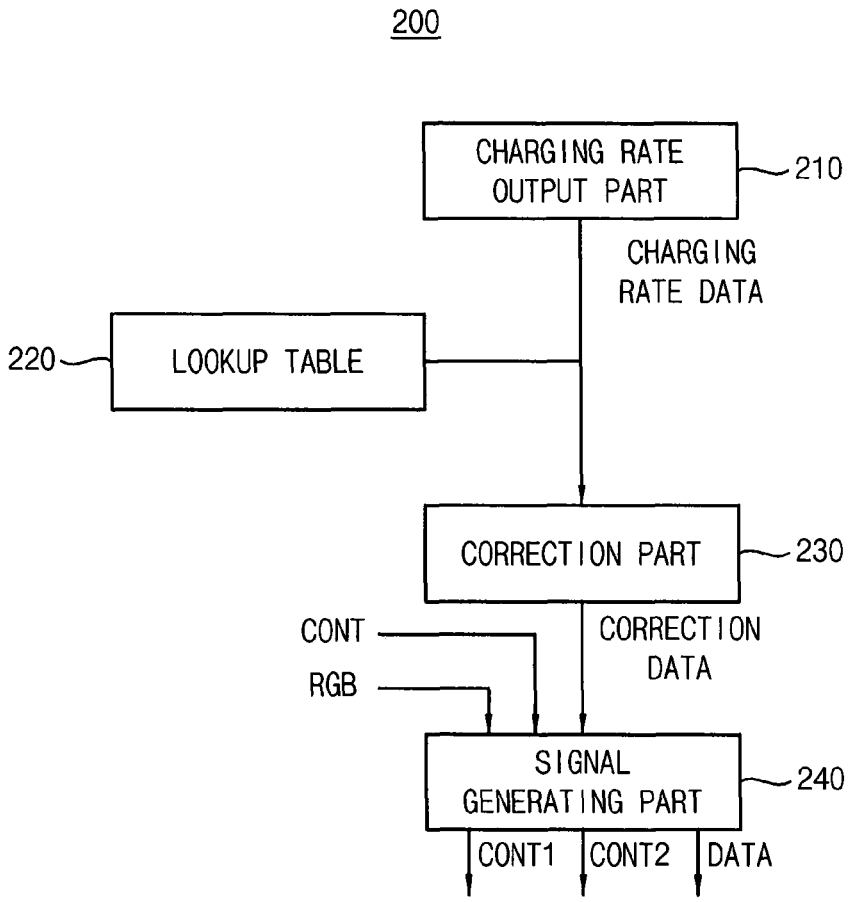
FIG. 3A is a block diagram illustrating a timing controller of FIG. 1.
Figure 3B:
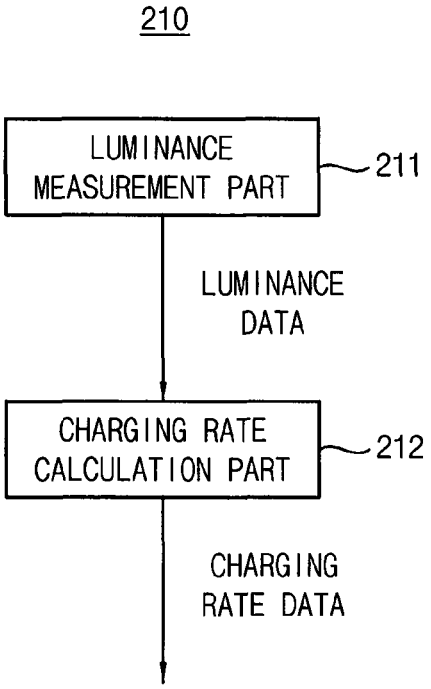
FIG. 3B is a block diagram illustrating a charging rate output part of FIG. 3A.
Figure 4:
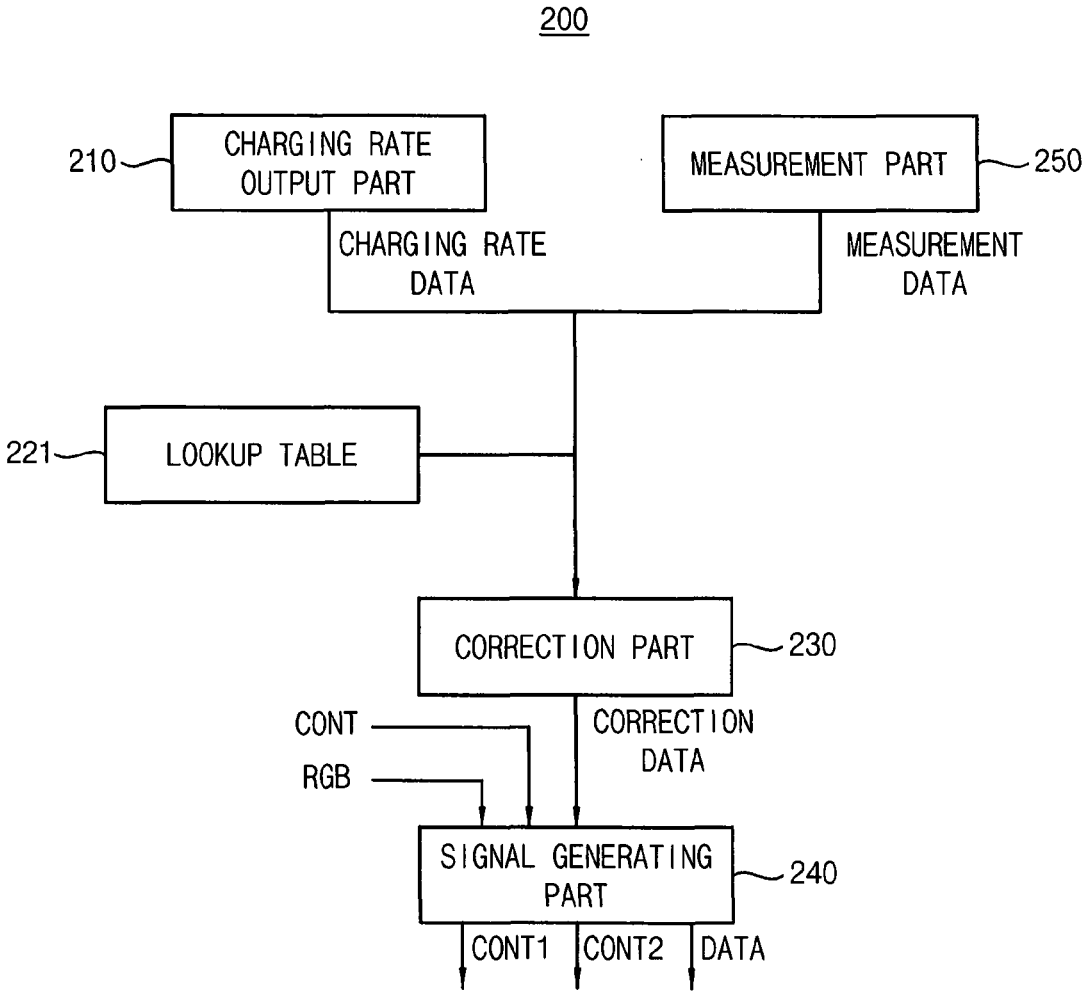
FIG. 4 is a block diagram illustrating a timing controller according to an exemplary embodiment of the present inventive concept.

The first and the second timing controller 201 and 202 are explained referring to FIGS. 3A to 4 in detail.

The first gate driving part 301 generates first, second to (j−1)-th and j-th gate signals GSj1, GSj2, . . . , GSjj−1, GSjj of the first area 101 in response to the first control signal CONT1 provided from the first timing controller 201, and respectively outputs the first, second to (j−1)-th and j-th gate signals GSj1, GSj2, . . . , GSjj−1, GSjj of the first area 101 to the first, second to (j−1)-th and j-th gate lines GLj1, GLj2, . . . , GLjj−1, GLjj disposed on the first area 101. The first, second to (j−1)-th and j-th gate signals GSj1, GSj2, . . . , GSjj−1, GSjj are explained referring to FIG. 2B in detail.

The first data driving part 401 outputs the data signals DSj to the data lines DLj of the first area 101 in response to the second control signal CONT2 and the data signal DATA provided from the first timing controller 201. The data signals DSj are explained referring to FIG. 2B in detail.

The second gate driving part 302 generates first, second to (k−1)-th and k-th gate signals GSk1, GSk2, . . . , GSkk−1, GSkk of the second area 102 in response to the first control signal CONT1 provided from the first timing controller 201, and respectively outputs the first, second to (k−1)-th and k-th gate signals GSk1, GSk2, . . . , GSkk−1, GSkk of the second area 102 to the first, second to (k−1)-th and k-th gate lines GLk1, GLk2, . . . , GLkk−1, GLkk disposed on the second area 102. The first, second to (k−1)-th and k-th gate signals GSk1, GSk2, . . . , GSkk−1, GSkk are explained referring to FIG. 2B in detail.

The second data driving part 402 outputs the data signals DSk to the data lines DLk of the second area 102 in response to the second control signal CONT2 and the data signal DATA provided from the second timing controller 202. The data signals DSk are explained referring to FIG. 2B in detail.

Figure 2A:
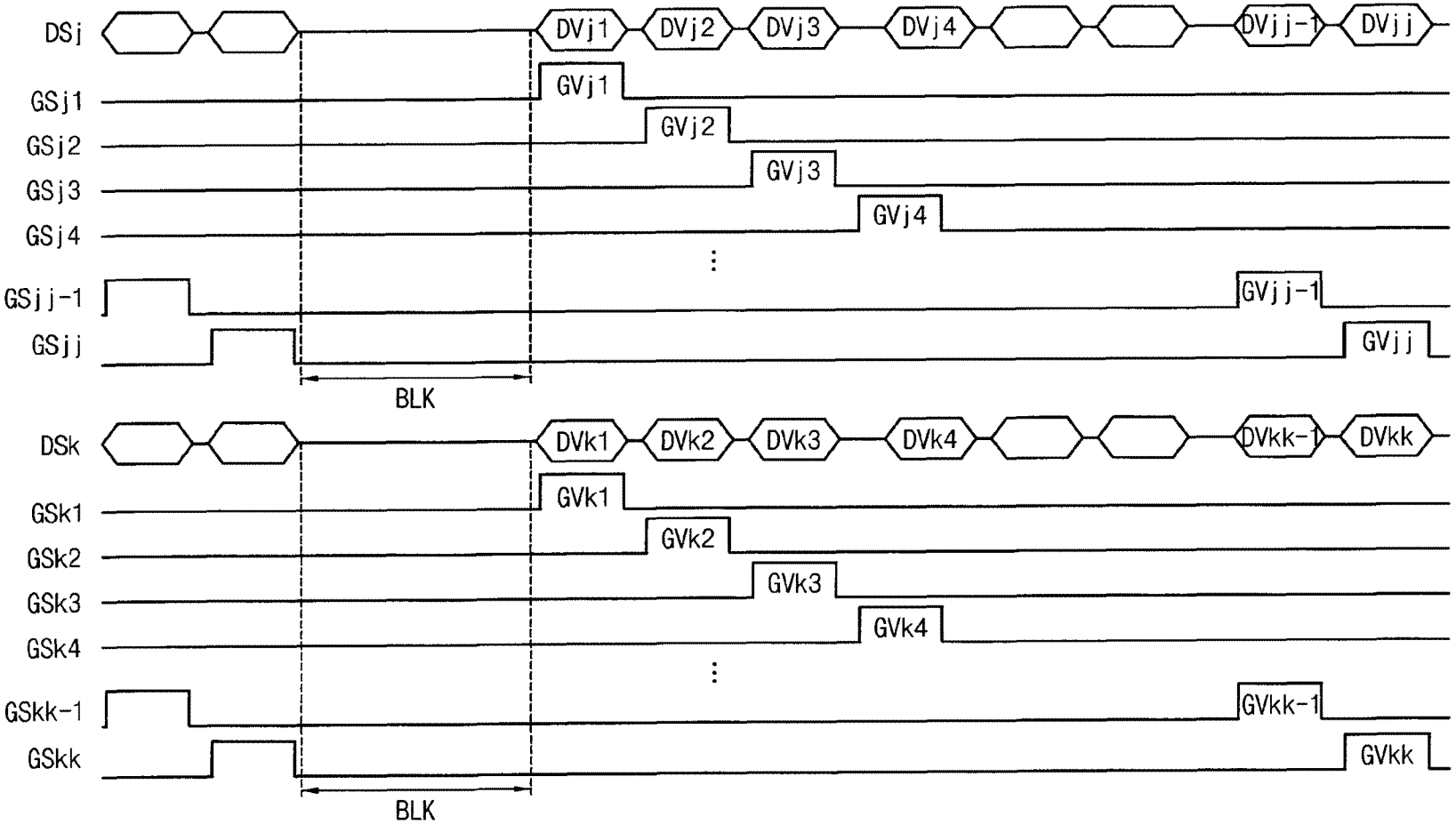
FIG. 2A is a waveforms diagram illustrating a data voltage signal and a gate signal according to a comparative example.
Figure 2B:
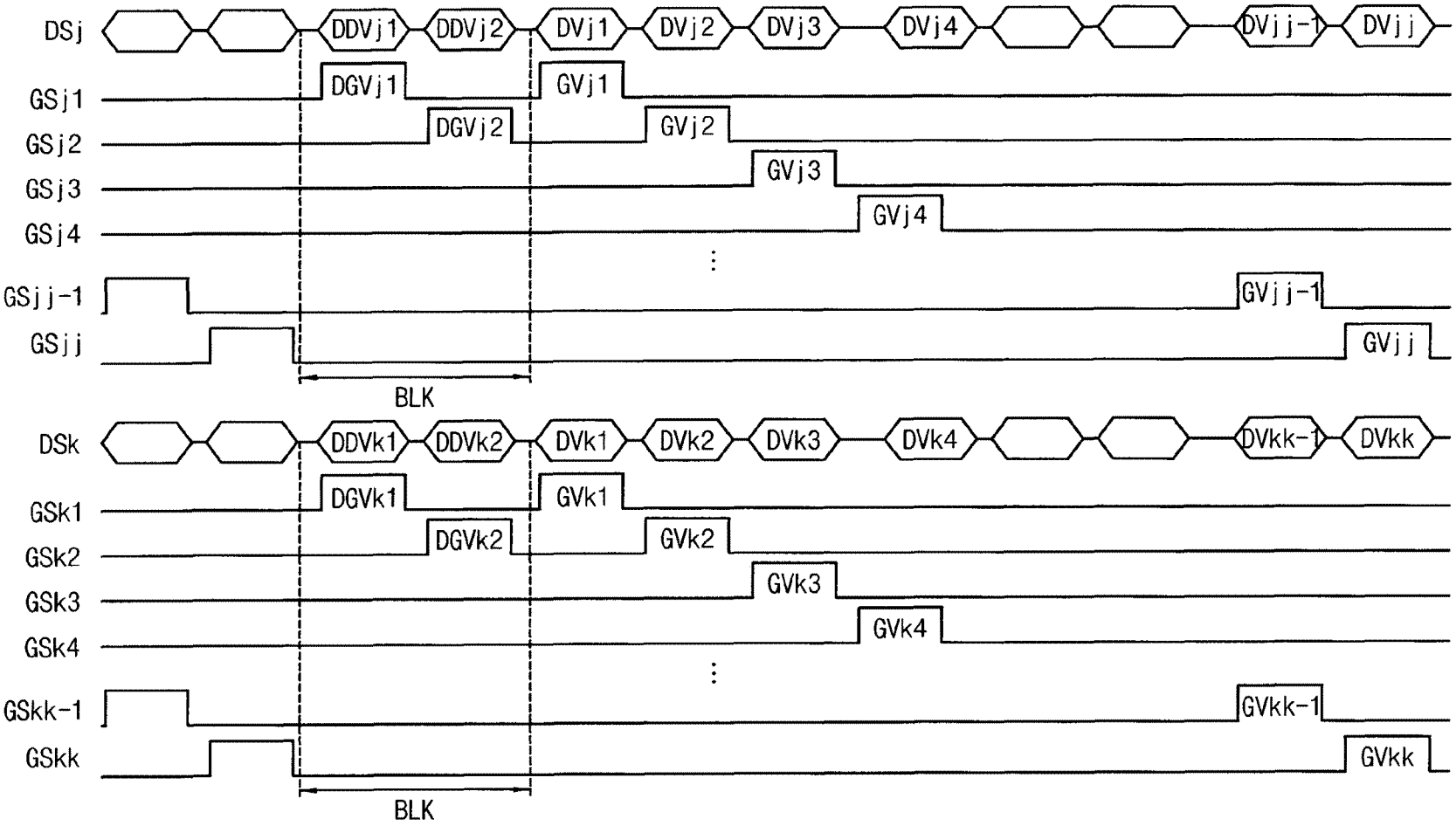
FIG. 2B is a waveforms diagram illustrating a data voltage signal and a gate signal of FIG. 1.

FIG. 2A is a waveforms diagram illustrating a data voltage signal and a gate signal according to a comparative example. FIG. 2B is a waveforms diagram illustrating a data voltage signal and a gate signal of FIG. 1.

Referring to FIGS. 1 and 2A, a first gate driving part 301 according to a comparative example generates first, second to (j−1)-th and j-th gate signals GSj1, GSj2, . . . , GSjj−1, GSjj of the first area 101 in response to the first control signal CONT1 provided from the first timing controller 201, and respectively outputs the first, second to (j−1)-th and j-th gate signals GSj1, GSj2, . . . , GSjj−1, GSjj of the first area 101 to the first, second to (j−1)-th and j-th gate lines GLj1, GLj2, . . . , GLjj−1, GLjj disposed on the first area 101. The first, second to (j−1)-th and j-th gate signals GSj1, GSj2, . . . , GSjj−1, GSjj do not have a dummy gate voltage during a blank period BLK.

The first data driving part 401 according to a comparative example outputs the data signals DSj to the data lines DLj of the first area 101 in response to the second control signal CONT2 and the data signal DATA provided from the first timing controller 201. The data signals DSj do not have a dummy data voltage during a blank period BLK.

The second gate driving part 302 according to a comparative example generates first, second to (k−1)-th and k-th gate signals GSk1, GSk2, . . . , GSkk−1, GSkk of the second area 102 in response to the first control signal CONT1 provided from the first timing controller 201, and respectively outputs the first, second to (k−1)-th and k-th gate signals GSk1, GSk2, . . . , GSkk−1, GSkk of the second area 102 to the first, second to (k−1)-th and k-th gate lines GLk1, GLk2, . . . , GLkk−1, GLkk disposed on the second area 102. The first, second to (k−1)-th and k-th gate signals GSk1, GSk2, . . . , GSkk−1, GSkk do not have a dummy gate voltage during a blank period BLK.

The second data driving part 402 according to a comparative example outputs the data signals DSk to the data lines DLk of the second area 102 in response to the second control signal CONT2 and the data signal DATA provided from the second timing controller 202. The data signals DSk do not have a dummy data voltage during a blank period BLK.

Referring to FIGS. 1 and 2B, a first gate driving part 301 according to an exemplary embodiment of the present inventive concept generates first, second to (j−1)-th and j-th gate signals GSj1, GSj2, . . . , GSjj−1, GSjj of the first area 101 in response to the first control signal CONT1 provided from the first timing controller 201, and respectively outputs the first, second to (j−1)-th and j-th gate signals GSj1, GSj2, . . . , GSjj−1, GSjj of the first area 101 to the first, second to (j−1)-th and j-th gate lines GLj1, GLj2, . . . , GLjj−1, GLjj disposed on the first area 101. The first gate signal GSj1 may have a first dummy gate voltage DGVj1 during a blank period BLK. The second gate signal GSj2 may have a second dummy gate voltage DGVj2 during a blank period BLK. An applying time and a level of the first dummy gate voltage DGVj1 and the second dummy gate voltage DGVj2 may be adjustable.

The first data driving part 401 according to an exemplary embodiment of the present inventive concept outputs the data signals DSj to the data lines DLj of the first area 101 in response to the second control signal CONT2 and the data signal DATA provided from the first timing controller 201. The data signals DSj may have a first dummy data voltage DDVj1 and a second dummy data voltage DDVj2 during a blank period BLK. The first dummy data voltage DDVj1 and a second dummy data voltage DDVj2 may be adjustable.

The first dummy gate voltage DGVj1 may be synchronized with the first dummy data voltage DDVj1. A pixel connected to the first gate line GLj1 may be pre-charged by the first dummy data voltage DDVj1. The second dummy gate voltage DGVj2 may be synchronized with the second dummy data voltage DDVj2. A pixel connected to the second gate line GLj2 may be pre-charged by the second dummy data voltage DDVj2.

The second gate driving part 302 according to an exemplary embodiment of the present inventive concept generates first, second to (k−1)-th and k-th gate signals GSk1, GSk2, . . . , GSkk−1, GSkk of the second area 102 in response to the first control signal CONT1 provided from the first timing controller 201, and respectively outputs the first, second to (k−1)-th and k-th gate signals GSk1, GSk2, . . . , GSkk−1, GSkk of the second area 102 to the first, second to (k−1)-th and k-th gate lines GLk1, GLk2, . . . , GLkk−1, GLkk disposed on the second area 102. The first gate signal GSk1 may have a first dummy gate voltage DGVk1 during a blank period BLK. The second gate signal GSk2 may have a second dummy gate voltage DGVk2 during a blank period BLK. An applying time and a level of the first dummy gate voltage DGVk1 and the second dummy gate voltage DGVk2 may be adjustable.

The second data driving part 402 according to an exemplary embodiment of the present inventive concept outputs the data signals DSk to the data lines DLk of the first area 101 in response to the second control signal CONT2 and the data signal DATA provided from the second timing controller 202. The data signals DSk may have a first dummy data voltage DDVk1 and a second dummy data voltage DDVk2 during a blank period BLK. The first dummy data voltage DDVk1 and a second dummy data voltage DDVk2 may be adjustable.

The first dummy gate voltage DGVk1 may be synchronized with the first dummy data voltage DDVk1. A pixel connected to the first gate line GLk1 may be pre-charged by the first dummy data voltage DDVk1. The second dummy gate voltage DGVk2 may be synchronized with the second dummy data voltage DDVk2. A pixel connected to the second gate line GLk2 may be pre-charged by the second dummy data voltage DDVk2.

According to the present exemplary embodiment, the pixels connected to the first gate line GLj1 and the second gate line GLj2 of the first area 101 may be pre-charged by the first and the second dummy gate voltage DGVj1 and DGVj2 and the first and the second dummy data voltage DDVj1 and DDVj2 during the blank period BLK. The first and the second dummy gate voltage DGVj1 and DGVj2 and the first and the second dummy data voltage DDVj1 and DDVj2 may be adjustable. In addition, the pixels connected to the first gate line GLk1 and the second gate line GLk2 of the second area 102 may be pre-charged by the first and the second dummy gate voltage DGVk1 and DGVk2 and the first and the second dummy data voltage DDVk1 and DDVk2 during the blank period BLK. The first and the second dummy gate voltage DGVk1 and DGVk2 and the first and the second dummy data voltage DDVk1 and DDVk2 may be adjustable. Therefore, a charging rate of a boundary of the first area 101 and the second area may be improved. In addition, a defect of display panel may be decreased.

FIG. 3A is a block diagram illustrating a timing controller of FIG. 1.

Referring to FIGS. 1, 2B and 3A, the first and the second timing controller 201 and 202 include a charging rate output part 210, a look-up table 220, a correction part 230 and a signal generating part 240.

The charging rate output part 210 measures a charging rate of pixels. The charging rate output part 210 generates a data of charging rate based on the charging rate. The charging rate output part 210 outputs the data of charging rate to the correction part 230.

A correction data to compensate the charging rate is stored in the look-up table 220. The correction data may be a data concerning an applying time and a level of the dummy gate voltage applied to the first or the second gate line. The correction data may be a data concerning the dummy data voltage synchronized with the dummy gate voltage. The correction data may be a data concerning a data voltage of a pixel pre-charged by the dummy data voltage.

The correction part 230 generates the correction data based on the data of charging rate and the look-up table 220. The correction part 230 outputs the correction data to the signal generating part 240.

The signal generating part 240 receives input image data RGB and an input control signal CONT from an external apparatus (not shown). The signal generating part 240 receives the correction data from the correction part 230. The input image data may include red image data R, green image data G and blue image data B. The input control signal CONT may include a master clock signal and a data enable signal. The input control signal CONT may include a vertical synchronizing signal and a horizontal synchronizing signal.

The signal generating part 240 generates the first control signal CONT1, the second control signal CONT2 and data signal DATA based on the input image data RGB, the input control signal CONT and the correction data.

The signal generating part 240 generates the first control signal CONT1 controlling the first and the second gate driving part 301 and 302 based on the input control signal CONT and the correction data to output to the first and the second gate driving part 301 and 302. The first control signal CONT1 may include a vertical start signal and a gate clock signal. The first control signal CONT1 may include information concerning an applying time and a level of the dummy gate voltage.

The signal generating part 240 generates the second control signal CONT2 controlling the first and the second data driving part 401 and 402 based on the input control signal CONT and the correction data to output to the first and the second data driving part 401 and 402. The first control signal CONT1 may include a horizontal start signal and a load signal. The first control signal CONT1 may further include an inversion control signal.

The signal generating part 240 generates the data signal DATA based on the input image data RGB. The signal generating part 240 outputs the data signal DATA to the first and the second data driving part 401 and 402. The data signal DATA may include information concerning the dummy data voltage.

The first and the second gate driving part 301 and 302 generates gate signals GS driving the gate lines GL in response to the first control signal CONT1 provided from the signal generating part 240. The first and the second gate driving part 301 and 302 sequentially output the gate signals GS to the gate lines GL. A first and a second gate signal of the gate signals GS may have the dummy gate voltage during the blank period BLK. An applying time and a level of the dummy gate voltage may be a corrected value corrected by the correction part 230.

The first and the second data driving part 401 and 402 receives the second control signal CONT1 and the data signal DATA from the signal generating part 240. The first and the second data driving part 401 and 402 convert the data signal DATA to a data voltage signal DS. The first and the second data driving part 401 and 402 output the data voltage signal DS to the data line DL. The data voltage signal DS may have the dummy data voltage during the blank period BLK. The dummy data voltage may be a corrected value corrected by the correction part 230.

According to the present exemplary embodiment, when a charging rate of a boundary of the first area 101 and second area 102 is deficient, the charging rate output part 210 perceives the deficiency of the charging rate of the boundary, the correction part 230 adjusts the dummy gate voltage, the dummy data voltage and the data voltage. Therefore, the charging rate may be improved.

FIG. 3B is a block diagram illustrating a charging rate output part of FIG. 3A.

Referring to FIGS. 1, 2B to 3B, the charging rate output part 210 may include a luminance measurement part 211 and a charging rate calculation part 212.

The luminance measurement part 211 measures a luminance of pixels. The charging rate calculation part 212 calculates a charging rate based on the measured luminance. The charging rate may be defined by the following Equation.

charging rate=luminance of a certain area/luminance of a normally charged area

The charging rate calculation part 212 outputs data of the charging rate to the correction part 230.

A correction data to compensate the charging rate may be stored in the look-up table 220. The correction data may be a data concerning an applying time and a level of the dummy gate voltage applied to the first or the second gate line. The correction data may be a data concerning the dummy data voltage synchronized with the dummy gate voltage. The correction data may be a data concerning a data voltage of a pixel pre-charged by the dummy data voltage.

The correction part 230 generates the correction data based on the data of charging rate and the look-up table 220. The correction part 230 outputs the correction data to the signal generating part 240.

The signal generating part 240 receives input image data RGB and an input control signal CONT from an external apparatus (not shown). The signal generating part 240 receives the correction data from the correction part 230. The input image data may include red image data R, green image data G and blue image data B. The input control signal CONT may include a master clock signal and a data enable signal. The input control signal CONT may include a vertical synchronizing signal and a horizontal synchronizing signal.

The signal generating part 240 generates the first control signal CONT1, the second control signal CONT2 and data signal DATA based on the input image data RGB, the input control signal CONT and the correction data.

The signal generating part 240 generates the first control signal CONT1 controlling the first and the second gate driving part 301 and 302 based on the input control signal CONT and the correction data to output to the first and the second gate driving part 301 and 302. The first control signal CONT1 may include a vertical start signal and a gate clock signal. The first control signal CONT1 may include information concerning an applying time and a level of the dummy gate voltage.

The signal generating part 240 generates the second control signal CONT2 controlling the first and the second data driving part 401 and 402 based on the input control signal CONT and the correction data to output to the first and the second data driving part 401 and 402. The first control signal CONT1 may include a horizontal start signal and a load signal. The first control signal CONT1 may further include an inversion control signal.

The signal generating part 240 generates the data signal DATA based on the input image data RGB. The signal generating part 240 outputs the data signal DATA to the first and the second data driving part 401 and 402. The data signal DATA may include information concerning the dummy data voltage.

The first and the second gate driving part 301 and 302 generates gate signals GS driving the gate lines GL in response to the first control signal CONT1 provided from the signal generating part 240. The first and the second gate driving part 301 and 302 sequentially output the gate signals GS to the gate lines GL. A first and a second gate signal of the gate signals GS may have the dummy gate voltage during the blank period BLK. An applying time and a level of the dummy gate voltage may be a corrected value corrected by the correction part 230.

The first and the second data driving part 401 and 402 receives the second control signal CONT1 and the data signal DATA from the signal generating part 240. The first and the second data driving part 401 and 402 convert the data signal DATA to a data voltage signal DS. The first and the second data driving part 401 and 402 output the data voltage signal DS to the data line DL. The data voltage signal DS may have the dummy data voltage during the blank period BLK. The dummy data voltage may be a corrected value corrected by the correction part 230.

FIG. 4 is a block diagram illustrating a timing controller according to an exemplary embodiment of the present inventive concept.

Referring to FIGS. 1, 2B, 3B and 4, the timing controller 200 may include a charging rate output part 210, a look-up table 221, a correction part 230 and a signal generating part 240. The timing controller 200 may include a first timing controller 201 and a second timing controller 202. The timing controller 200 may further include a measurement part 250.

The charging rate output part 210 measures a charging rate of pixels. The charging rate output part 210 generates a data of charging rate based on the charging rate.

The charging rate output part 210 may include a luminance measurement part 211 and a charging rate calculation part 212. The luminance measurement part 211 measures a luminance of pixels. The charging rate calculation part 212 calculates a charging rate based on the measured luminance. The charging rate may be defined by the following Equation.

$$\text{charging rate} = \text{luminance of a certain area} / \text{luminance of a normally charged area}$$

The charging rate output part 210 outputs data of the charging rate to the correction part 230.

The measurement part 250 may measure various data of a display panel. For example, the measurement part 250 may measure a temperature of each area of the display panel. The measurement part 250 may measure a gray scale value of each pixel of the display panel. The measurement part 250 may measure a RC-delay of each area of the display panel.

The measurement part 250 outputs the measured data to the correction part 230.

A correction data to compensate the charging rate may be stored in the look-up table 221. The correction data may be a data concerning an applying time and a level of the dummy gate voltage applied to the first or the second gate line. The correction data may be a data concerning the dummy data voltage synchronized with the dummy gate voltage. The correction data may be a data concerning a data voltage of a pixel pre-charged by the dummy data voltage.

The correction data of the look-up table 221 may be a value based on a characteristic of charging rate according to the temperature. The correction data of the look-up table 221 may be a value based on a characteristic of charging rate according to the gray scale value. The correction data of the look-up table 221 may be a value based on a characteristic of charging rate according to the RC-delay.

The correction part 230 generates the correction data based on the data of charging rate and the look-up table 221. The correction part 230 outputs the correction data to the signal generating part 240.

The signal generating part 240 receives input image data RGB and an input control signal CONT from an external apparatus (not shown). The signal generating part 240 receives the correction data from the correction part 230. The input image data may include red image data R, green image data G and blue image data B. The input control signal CONT may include a master clock signal and a data enable signal. The input control signal CONT may include a vertical synchronizing signal and a horizontal synchronizing signal.

The signal generating part 240 generates the first control signal CONT1, the second control signal CONT2 and data signal DATA based on the input image data RGB, the input control signal CONT and the correction data.

The signal generating part 240 generates the first control signal CONT1 controlling the first and the second gate driving part 301 and 302 based on the input control signal CONT and the correction data to output to the first and the second gate driving part 301 and 302. The first control signal CONT1 may include a vertical start signal and a gate clock signal. The first control signal CONT1 may include information concerning an applying time and a level of the dummy gate voltage.

The signal generating part 240 generates the second control signal CONT2 controlling the first and the second data driving part 401 and 402 based on the input control signal CONT and the correction data to output to the first and the second data driving part 401 and 402. The first control signal CONT1 may include a horizontal start signal and a load signal. The first control signal CONT1 may further include an inversion control signal.

The signal generating part 240 generates the data signal DATA based on the input image data RGB. The signal generating part 240 outputs the data signal DATA to the first and the second data driving part 401 and 402. The data signal DATA may include information concerning the dummy data voltage.

The first and the second gate driving part 301 and 302 generates gate signals GS driving the gate lines GL in response to the first control signal CONT1 provided from the signal generating part 240. The first and the second gate driving part 301 and 302 sequentially output the gate signals GS to the gate lines GL. A first and a second gate signal of the gate signals GS may have the dummy gate voltage during the blank period BLK. An applying time and a level of the dummy gate voltage may be a corrected value corrected by the correction part 230.

The first and the second data driving part 401 and 402 receives the second control signal CONT1 and the data signal DATA from the signal generating part 240. The first and the second data driving part 401 and 402 convert the data signal DATA to a data voltage signal DS. The first and the second data driving part 401 and 402 output the data voltage signal DS to the data line DL. The data voltage signal DS may have the dummy data voltage during the blank period BLK. The dummy data voltage may be a corrected value corrected by the correction part 230.

According to the present exemplary embodiment, when a charging rate of a boundary of the first area 101 and second area 102 is deficient, the charging rate output part 210 perceives the deficiency of the charging rate of the boundary, the correction part 230 adjusts the dummy gate voltage, the dummy data voltage and the data voltage. In addition, since temperature, gray scale value and RC-delay of the display panel is considered, a compensation of charging rate may be more accurate.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A method of driving a display panel, the method comprising;

outputting a dummy gate voltage to a gate line disposed on a boundary between a first area of the display panel and a second area of the display panel adjacent to the first area during a blank period between a plurality of scanning periods; and outputting a dummy data voltage to a data line during the blank period, wherein the first area and the second area are scanned in a direction away from the boundary, wherein a value and an applying time of the dummy gate voltage are retrieved from a look-up table based on a grayscale value of a normal data voltage applied to a pixel disposed on the boundary.

2. The method of claim 1, further comprising:

outputting a normal gate voltage to the gate line during a scanning period; and outputting the normal data voltage to the data line during a scanning period.

3. The method of claim 2, further comprising:

adjusting the normal data voltage applied to a pixel disposed on the boundary.

4. The method of claim 2, wherein a value and an applying time of the dummy gate voltage is determined based on a temperature of the boundary.

5. The method of claim 2, further comprising:

determining a value of the dummy data voltage based on a grayscale value of the normal data voltage applied to a pixel disposed on the boundary.

6. The method of claim 2, wherein a value of the dummy data voltage is determined based on a temperature and a position of the boundary.

7. The method of claim 2, further comprising:

calculating a charging rate of a pixel disposed on the boundary, and wherein a value and an applying time of the dummy gate voltage and a value of the dummy data voltage are determined based on the charging rate.

8. The method of claim 7, wherein calculating the charging rate of the pixel disposed on the boundary comprises:

measuring a luminance of the display panel according to a position; and calculating the charging rate based on the luminance.

9. A display apparatus, comprising:

a display panel comprising a first area and a second area adjacent to the first area, and comprising a gate line and a data line disposed on the first and second area;

a timing controller configured to determine a value of a dummy data voltage and a value of a normal data voltage;

a gate driving part configured to output a dummy gate voltage to a gate line disposed on a boundary between the first area and the second area during a blank period between a plurality of scanning periods; and a data driving part configured to output a dummy data voltage to the data line during the blank period, wherein the first area and the second area are scanned in a direction away from the boundary, wherein the timing controller comprises a look-up table in which a value and an applying time of the dummy gate voltage based on a grayscale value of a normal data voltage are stored.

10. The display apparatus of claim 9, wherein the gate driving part outputs a normal gate voltage to the gate line during a scanning period, and wherein the data driving part outputs the normal data voltage to the data line during a scanning period.

11. The display apparatus of claim 10, wherein the timing controller comprises:

a look-up table in which a value and an applying time of the dummy gate voltage based on a temperature of the boundary are stored.

12. The display apparatus of claim 10, wherein the timing controller comprises:

a look-up table in which a value of the dummy data voltage based on a grayscale value of the normal data voltage is stored.

13. The display apparatus of claim 10, wherein the timing controller comprises:

a look-up table in which a value of the dummy data voltage based on a temperature and a position of the boundary is stored.

14. The display apparatus of claim 10, wherein the timing controller comprises:

a charging rate output part configured to calculate a charging rate of a pixel disposed on the boundary; and a look-up table in which a value and an applying time of the dummy gate voltage based on the charging rate.

15. The display apparatus of claim 14, wherein the charging rate output part comprises:

a luminance measurement part configured to measure a luminance of the display panel according to a position; and a charging rate calculation part configured to calculate the charging rate based on the luminance.

* * * * *